United States Patent [19]

Partridge

[11] 4,098,955

[45] Jul. 4, 1978

[54] PREVENTION OF SHIPWORM INFESTATION OF WOODEN MARINE STRUCTURES

[75] Inventor: Walter E. Partridge, Auburn, Wash.

[73] Assignee: E. I. Du Pont de Nemours and Company, Wilmington, Del.

[21] Appl. No.: 730,516

[22] Filed: Oct. 7, 1976

[51] Int. Cl.[2] ..... B32B 21/04; B32B 21/06

[52] U.S. Cl. ..... 428/537; 156/184; 156/185; 428/296; 428/907

[58] Field of Search ..... 428/288, 284, 286, 287, 428/296, 537, 541, 907; 156/184, 185

[56] References Cited

U.S. PATENT DOCUMENTS

| | | | |
|---|---|---|---|
| 2,955,642 | 10/1960 | Stark | 428/907 X |
| 3,219,505 | 11/1965 | Hilding | 428/907 X |
| 3,505,758 | 4/1970 | Willisford | 428/907 X |
| 3,517,514 | 6/1970 | Visser et al. | 61/38 |
| 3,551,192 | 12/1970 | Reinert | 428/907 X |
| 3,563,838 | 2/1971 | Edwards | 428/286 X |
| 3,754,362 | 8/1973 | Daimler | 428/296 X |
| 3,953,974 | 5/1976 | Bresson et al. | 428/296 X |
| 3,975,224 | 8/1976 | Ruzek | 428/296 X |
| 3,991,244 | 11/1976 | Debbas | 428/296 X |

OTHER PUBLICATIONS

G. Bramhall "Marine Borers and Wooden Piling in British Columbia Waters", Department of Forestry Publication No. 1138, pp. 15–21 (1966).

D. B. Quayle "The British Columbia Shipworm", Report of Provincial Fisheries Department, 1955, pp. 92–104 (1956).

B. Gulliksen, "Marine Boring and Fouling Organisms", Fauna, Olso, 27, 185–195 (1974).

*Primary Examiner*—Lorraine T. Kendell

[57] ABSTRACT

An improved method is provided for solving the age-old problem of wood-boring marine organisms. Wooden structures which are exposed to sea water can be protected from shipworm infestation by surrounding the structure with a nonwoven fabric having an effective pore size of less than 200 microns. Nonwoven fabrics of non-cellulosic organic or inorganic fibers are suitable. A self-bonded nonwoven fabric of polypropylene fibers is preferred. The fabric has high tensile and tear strengths, good puncture resistance, and a small effective pore size. The method may be used on new structures or old ones that are already infested with marine wood-borers.

5 Claims, No Drawings

PREVENTION OF SHIPWORM INFESTATION OF WOODEN MARINE STRUCTURES

BACKGROUND OF THE INVENTION

1. Field of the Invention

This invention concerns a method of protecting a wooden structure from infestation with wood-boring marine organisms and in particular, concerns an improved method wherein such a structure is surrounded by a protective barrier.

2. Prior Art

As noted by B. Gulliksen, "Marine Boring and Fouling Organisms", Fauna, Vol. 27, No. 4, p. 185–195 (Oslo) 1974, wood-boring marine organisms have presented mankind with a world-wide problem since ancient times. The ancient bard Homer and the great explorer Columbus were familiar with the hazards presented by these wood-borers. An example of such a destructive organism is the Teredo worm, or shipworm, which has been known to infest wooden structures, such as pilings, rafts, log floats and the like, to such an extent that the wood loses its strength and becomes so eaten away that the structures lose their buoyancy and sink.

Various methods have been suggested for overcoming the marine-borer problem. The most common solution has been the use of creosote-impregnated wood. Impregnation or coating of the wood with resins or other preservative substances or treatment of the wood with substances which are toxic to the borers, have been suggested. The use of eucalyptus wood has been reported to provide satisfactory results. A sheathing of the wood with Muntz metal (i.e., a brass alloy containing 60% copper and 40% zinc) has also been used in the past. Although each of the methods are reported to have met with some success in combating the problem of shipworm infestation, these methods are not totally satisfactory because of the high cost, odor, and toxicity of the various impregnants, preservatives and coatings, the unavailability of special woods, and the difficulty of installation and high cost of metal sheathing. Most of these problems are exacerbated in remote logging camps, where shipworms are an especially costly nuisance.

SUMMARY OF THE INVENTION

In contrast to the expensive and inconvenient methods of the prior art, the present invention provides an improved method for combating infestation of a wood structure by wood-boring marine organisms wherein the wood is protected by a surrounding barrier, the improvement comprising surrounding the portions of the wood structure exposed to a marine environment with a nonwoven fabric of non-cellulosic synthetic fibers, the fabric having an effective pore size of less than 200 microns. Preferably the effective pore size is no greater than 180 microns, and most preferably, no greater than 150 microns. The fabrics are of man-made organic or inorganic fibers. A self-bonded nonwoven fabric of polypropylene fibers is preferred. Generally, the fabrics have a grab tensile strength of at least about 60 pounds, preferably at least 100 pounds; a trapezoidal tear strength of at least about 30 pounds, preferably at least 50 pounds; and a puncture resistance of at least 350 inch-pounds/square inch, preferably at least 450 inch-pounds/square inch. The invention also includes a wooden structure protected from infestation with wood-boring marine organisms wherein the portions of the structure to be exposed to sea water are surrounded by a nonwoven fabric of the type described above.

DETAILED DESCRIPTION OF THE INVENTION

We have found that new wooden structures, protected by a surrounding barrier of nonwoven fabric, in accordance with the invention, do not become infested with shipworms even when exposed for very long times in sea water that is known to contain large concentrations of the shipworms. It has also been found that in old wood that had already become infested with shipworms, within a short time after having been surrounded with a fabric according to the invention, the shipworms die and no further shipworm activity occurs.

According to the invention, a nonwoven fabric of non-cellulosic synthetic fibers is wrapped around the portions of the wooden structure that are to be protected from wood-boring marine organisms. So long as the portion to be exposed is completely surrounded by the fabric, full protection against shipworm, as well as other marine borers and several other fouling organisms, is provided. The surrounding fabric may be attached to the structure in various ways, such as by nailing or stapling. It is not necessary that the fabric fit snuggly around the protected member. The fabric may be loosely fitting or hanging, so long as it forms a surrounding barrier.

As used herein, the term "nonwoven fabric" is intended to include a nonwoven structure, or a reinforced matting, of synthetic fibers or filaments. As used hereinafter, the term "fibers" is intended to include both staple fibers and/or substantially continuous filaments. The fibers are inherently, or treated to be, chemically resistant to sea water. Synthetic (i.e., man-made) fibers of organic or inorganic (e.g., glass) materials are generally suited for the fabrics to be used according to the present invention. Synthetic organic fibers made of polyolefins, polyesters or polyamides are generally suitable. Polypropylene fibers are preferred. A highly preferred mode of the invention utilizes a nonwoven fabric of self-bonded polypropylene fibers because of its lightweight (i.e., a density of less than 1 g/cc) and its high strength. A fabric of this type which has been found to be particularly useful in this invention is Typar® spunbonded polypropylene, a nonwoven fabric sold by E. I. du Pont de Nemours and Company. Such spunbonded polypropylene nonwoven fabrics and a method for their manufacture are described in Edwards, U.S. Pat. No. 3,563,838. Usually, this material is available in widths of no more than about 15 feet but in almost any practicable length up to about 1000 yards. When even wider widths are required to surround very large underwater portions of marine structures, the widths can be sewed together to form the desired dimensions and the seams then impregnated or coated with a sea-water-resistant material, such as a synthetic rubber latex.

The fabrics used in accordance with the present invention are sea-water resistant. That is, the fabrics are chemically stable in sea water and are resistant to attack by marine organisms to such an extent that the integrity of the fabric as a protective surrounding material for the wood remains unimpaired for at least three years and preferably for at least a decade. Should the fabric or portions thereof deteriorate after such a time period, and it is still desired to protect the wood structure, the fabric or portion thereof can be readily and economically replaced, without impairing the wood. In some uses, as for example when the fabric is used to protect wood pilings which are desired to last for decades, the resistance of the fabric itself to sea water and marine organisms is especially important. Cellulosic fibers, that have not been specially treated to be so resistant, are therefore generally inappropriate.

Nonwoven fabrics suitable for use with the present invention generally have an effective pore size (as defined hereinafter) of less than 200 microns, preferably no greater than 180 microns, and most preferably no greater than 150 microns. With nonwoven fabrics of such pore sizes, a satisfactory barrier can be provided for a wood structure so that shipworm infestation is prevented. Generally, teredo worms, in the adult or larva stage, are of such a size, that they cannot pass through a nonwoven barrier having small pores. The pores in the nonwoven fabric are a consequence of the fabric construction method. For example, pores, holes, or openings (all referred to herein as "pores") are formed in the fabric by the needles used in preparing a needle-punched matting, or by the particular manner in which the fibers are assembled in a spunbonded nonwoven.

Among the other desired characteristics of the nonwoven fabrics for use in accordance with the invention are high tensile strength, high tear strength, puncture resistance, light weight, and adequate permeability.

Fabrics having strong tensile properties are particularly desirable for ease of handling and installation, as well as for their ability to withstand tensile stresses that may be placed on the fabric by the relative movement of portions of the surrounded wood structure during service. Grab tensile strengths, measured in accordance with ASTM D-1682, of at least 100 pounds have been found especially useful in the fabrics employed according to the present invention. However, if the fabric is not to be subjected to significant stresses during handling, installation or use, considerably lower tensile strengths (e.g., 60 pounds) can be satisfactory.

Tear resistance is another desirable feature of the fabrics to be used according to the invention. The actual tear resistance may be dictated by the particular structure which is to be protected, the particular method by which the fabric is to be installed and by the particular environment in which the fabric is to be used. A trapezoidal tear resistance of at least 50 pounds/inch, measured according to the method of ASTM D-2263, has been found particularly useful in surrounding large structures such as logging-camp floats. Of course, if the fabric is to be used where little possibility of tearing is encountered, then lower tear strengths (e.g., 30 pounds) can be satisfactory.

Puncture resistance, to protect the fabric from sharp objects during installation and service, is desirable for providing long life to the fabric. A Spencer puncture resistance of at least 450 inch-pounds/square inch, measured according to the ASTM D-781 with a 3/16-inch diameter probe has been found particularly useful. In environments where the possibility of puncture by sharp underwater objects is low, a lower puncture resistance (e.g., 350 in. lb./in.$^2$), can be satisfactory.

A light weight nonwoven of the above-described type having a coefficient of water permeability of 0.01 cm/sec, has been fully satisfactory when used according to the present invention. Fabrics having lower or higher permeabilities can perform satisfactorily, as long as the "pore" size, as explained above, is not excessive.

The effective pore size of a fabric can be measured as follows by means of a series of sieving tests with sand having a known narrow range of particle sizes. A sample of the nonwoven fabric under study is fitted into a standard sieve screen tray from which the screen has been removed. The thusly-fitted tray is placed in a laboratory sieve-screen shaker (e.g., an EML 200-67 machine made by Haver & Böcker Old Westfalen, West Germany). A 250-gram sample of sand of known particle size is loaded atop the fabric and the tray is shaken with a horizontal amplitude of 1.5 mm for 5 minutes. The particle size of the sand and the percentage of sand retained retained atop the fabric at the end of the test are recorded. The data are then plotted so that the particle size versus percentage retained atop the fabric can then be determined directly for any given percent retention. The value of the particle size for 90% sand retention is defined herein as the "effective pore size" of the nonwoven fabric.

The fabric found most useful in the practice of the present invention and which was used in each of the following illustrative examples was Typar® spunbonded polypropylene, a self-bonded nonwoven fabric having four laminated layers of substantially continuous polypropylene filaments assembled in a highly directional manner in each layer so that the four-layer composite has very high tensile strengths in the length and the cross-length directions and a lesser, but still fully satisfactory, strength in the 45°-bias direction. The material weighs about 4 ounces/square yard, is about 0.015 inch thick and has the following characteristics.

| | |
|---|---|
| Average grab tensile strength | 120 lbs |
| Average trapezoidal tear strength | 57 lbs |
| Spencer puncture resistance | 478 in-lbs/in$^2$ |
| Coefficient of $H_2O$ permeability | 0.012 cm/sec |
| Size of sand articles at | |
| 50% retention | 82 microns |
| 90% retention | 130 microns |
| 98% retention | 150 microns |
| Effective pore size | 130 microns. |

EXAMPLE 1

This example demonstrates the effectiveness of protecting wooden structures from marine borers in accordance with the invention. A comparison is made between a protected and nonprotected control exposed to a Teredo-worm infested environment.

Four wooden blocks, each measuring 4 inches by 4 inches by 3 feet, were cut from prime spruce lumber. Two blocks were each placed in a Typar® spunbonded polypropylene envelope which was then taped shut. The other two blocks were used as controls. A pair of test samples was then prepared, each consisting of a control block and a Typar®-enveloped block. The two samples were strapped together, weighted with a chain and suspended to a depth of about 4 feet in Neets Bay, Alaska, a body of water known to be infested with Teredo worms.

After 140 days of exposure, one pair of test samples was removed from the bay. The blocks were split and examined for Teredo-worm infestation. Teredo worms up to ¼ inch in diameter were found growing in the control block. No Teredo worms were found in the Typar® wrapped block.

The second set of blocks were removed after 225 days of exposure, then split and examined for Teredo worm infestation. As with the first set of test blocks, the control block was infested with Teredo worms, while the block protected with Typar® in accordance with the invention was found to be free of any Teredo worms.

EXAMPLE 2

This example demonstrates the method of the invention in stopping Teredo worm activity in an already infested large log float.

A log float, measuring 90 feet long by 80 feet wide, of the type on which logging camp buildings are erected, had been floating in Neets Bay, Alaska, for approximately 4 months. The float had already become infested with Teredo worms and mussels, clams and barnacles were also growing on the bottom of the float. If the Teredo-worm infestation were not stopped, the worms usually would cause such a float to sink within a period of 6 to 10 years.

After the 4 months of exposure, a Typar® spunbonded polypropylene fabric was installed to protect the exposed surfaces of the float. The fabric measured 120 feet long and 100 feet wide. The fabric was first placed atop the float near one edge. Weights were attached to the one end of the fabric. Ropes were then attached to the weights and fed under the float to the opposite side. The weighted end of the fabric was then fed off the side of the float and pulled under the float to the other side, thereby covering the bottom of two sides of the float. The two ends were then tied down with rope and stapled to the top of the float. The Typar® was also attached to the other two sides of the float; one side by means of ropes and staples, and the other side by means of an aluminum sheet, which was stapled in place over the fabric. Thus, the Typar® spunbonded polypropylene fabric surrounded the sides and bottom of the float. At the sides of the float, the fabric was flush against the wood. Under the float, the fabric was hanging, generally to a depth of 2 to 5 feet, below the bottom of the float.

The fabric had been installed on the float in mid-autumn. By the middle of the ensuing winter, a smell, indicative of dead marine organisms was noted coming from the float. At the end of the winter, underwater examination was made of the region between the fabric and the bottom of the float. Surprisingly, no life of any kind could be detected attached to the logs. Even the mussels, clams and barnacles were dead. A section was cut from one log of the float. The hole made by a Teredo worm was found in the section, but the worm was dead.

I claim:

1. A method for combating infestation of a wood structure by wood-boring marine organisms consisting essentially of surrounding all the portions of the wood structure exposed to a marine environment with a protective barrier, said barrier consisting essentially of a porous nonwoven fabric consisting essentially of self-bonded polypropylene fibers, the fabric having a grab tensile strength of at least 60 pounds, a trapezoidal tear strength of at least 30 pounds, a puncture resistance of at least 350 inch-pounds/square inch and an effective pore size of less than 200 microns.

2. A method according to claim 1 wherein the effective pore size is no greater than 180 microns.

3. A method according to claim 2 wherein the fabric weighs 3 to 5 ounces/square yard and the tensile strength is at least 100 pounds, the tear strength is at least 50 pounds, the puncture resistance is at least 450 inch-pounds/square inch and the effective pore size is no greater than 150 microns.

4. A wooden structure protected from infestation by wood-boring marine organisms wherein said protection consists essentially of a porous nonwoven fabric consisting essentially of self-bonded polypropylene fibers, the fabric having a grab tensile strength of at least 60 pounds, a trapezoidal tear strength of at least 30 pounds, a puncture resistance of at least 350 inch-pounds/square inch and an effective pore size of less than 200 microns and completely surrounding all portions of said structure exposed to sea water.

5. The structure of claim 4 wherein the fabric has an effective pore size of no greater than 180 microns.

* * * * *